US006723191B2

(12) United States Patent
Espagnacq et al.

(10) Patent No.: US 6,723,191 B2
(45) Date of Patent: Apr. 20, 2004

(54) SLOW COMBUSTION PYROTECHNIC COMPOSITION

(75) Inventors: André Espagnacq, Bourges (FR); Philippe Morand, Allouis (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/111,314

(22) PCT Filed: Sep. 26, 2001

(86) PCT No.: PCT/FR01/02981

§ 371 (c)(1),
(2), (4) Date: Apr. 23, 2002

(87) PCT Pub. No.: WO02/26662

PCT Pub. Date: Apr. 4, 2002

(65) Prior Publication Data

US 2002/0162615 A1 Nov. 7, 2002

(30) Foreign Application Priority Data

Sep. 27, 2000 (FR) ..... 00 12490

(51) Int. Cl.[7] ..... C06B 29/22
(52) U.S. Cl. ..... 149/76
(58) Field of Search ..... 149/75, 76, 77, 149/21

(56) References Cited

U.S. PATENT DOCUMENTS 6,427,599 B1 * 8/2002 Posson et al. ..... 102/336

FOREIGN PATENT DOCUMENTS

| | | |
|---|---|---|
| EP | 0 610 094 A1 | 8/1994 |
| EP | 0 630 876 A1 | 12/1994 |
| GB | 560 227 A | 5/1944 |

OTHER PUBLICATIONS

Chemical Abstracts, vol. 65, No. 11, Nov. 21, 1966, Pokhil et al., "Surface structure of burning model mixtures of solid fuels", XP002169267.

Chemical Abstracts, vol. 81, No. 16, Oct. 21, 1974, Glazkova, "Inhibiting effect of reducing agents on the combustion of ammonium perchlorate", XP002169268.

* cited by examiner

*Primary Examiner*—Michael J. Carone
*Assistant Examiner*—Aileen B. Felton
(74) *Attorney, Agent, or Firm*—Oliff & Berridge, PLC

(57) ABSTRACT

The invention relates to a slow combustion composition for long duration pyrotechnic delays. It comprises an oxidant of the perchlorate type according to a percentage in mass of between 75 to 91%, a reductant selected from among the aromatics according to a percentage in mass of between 5 to 20%, 0 to 6% of a binder and 0 to 5% in mass of a nanometric silica powder. Application to the manufacture of cords or fuses for delays having a combustion rate of around 1 mm/s.

16 Claims, No Drawings

SLOW COMBUSTION PYROTECHNIC COMPOSITION

BACKGROUND OF THE INVENTION

The technical scope of the present invention is that of pyrotechnic compositions intended to make pyrotechnic delays that are to be integrated into a piece of ammunition, in a safety and arming device or in a safety fuse.

When a piece of ammunition or pyrotechnic system is to be designed incorporating a long duration timer device (from several seconds to several minutes), a clock or electronic timing device may be implemented, or else a chemical reaction may be used.

These solutions are both costly and bulky. Ammunition designers therefore prefer to use pyrotechnic delays (rigid column or cord) since such solutions are compact, reliable, robust and inexpensive.

However, a particularly long timing in a small sized ammunition is extremely difficult to produce using a pyrotechnic composition.

Thus, patent FR-2 464 932 proposes a composition for a delay cord comprising tungsten powder (W), barium chromate ($BaCrO_4$), and potassium perchlorate ($KClO_4$). This composition has a combustion rate of 4 mm/s in a sheath of 3 mm external diameter (the thickness of tin sheaths is generally of around 0.5 mm).

Patent FR-A-2 706 449 in the name of the applicant proposes an improvement to the composition described in the previous patent by incorporating nanometric silica powder. Such a composition allows a combustion rate of 2 to 2.5 mm/s to be obtained in a sheath of 3.1 mm external diameter. The silica thus introduced prevents the cord from bursting but is in proportions that are too low to substantially modify the combustion rate of the composition.

Reference may further be made to patents U.S. Pat. No. 3,028,229 and EP-0 332 986 that describe compositions essentially comprising metallic powder.

Known tungsten, barium chromate, potassium perchlorate and possibly silica-based compositions generally have a combustion rate of around or over 2 mm/s. These compositions have the particularity of generating almost no gases whilst burning.

The cord technology is well suited to the manufacture of delays for ammunition. This technology allows longer delay columns to be made and allows complex shapes to be made that may be adapted to a reduced available volume. Thus, timing of 15 s may easily be obtained by implementing a cord length of 35 mm enclosing a composition such as that described in patent FR-2 706 449.

However, if a longer timing is required (for example 30 s) without requiring the implementation of a longer (and therefore bulkier) cord, a composition having a combustion rate of around 1 mm/s must be used.

SUMMARY OF THE INVENTION

The aim of the present invention is to supply a new composition with a slow combustion rate, of around 1 mm/s, intended to be incorporated into a piece of ammunition or one of its components, for example a safety and arming device.

The invention thus relates to a slow combustion pyrotechnic composition notably intended to manufacture pyrotechnic delays, said composition wherein it comprises an oxidant of the perchlorate type according to a percentage in mass of between 75 and 91%, a reductant selected from among the aromatics according to a percentage in mass of between 5 and 20%, 0 to 6% in mass of a binder and 0 to 5% in mass of a nanometric silica powder.

Advantageously, the oxidant may be ammonium perchlorate.

Advantageously, the reductant may be constituted by anthracene, phenanthrene, naphthalene or a mixture of these.

According to a first embodiment, the composition may comprise a binder that is constituted by a wax.

The composition may, in this case, be constituted in mass by 75 to 91% of perchlorate, 5 to 20% of aromatics and 1 to 6% of binder.

According to different examples, it may notably be constituted in mass by:

- 91% of ammonium perchlorate, 7% of anthracene and 2% of wax, or
- 88% of ammonium perchlorate, 7% of anthracene and 5% of wax, or
- 88% of ammonium perchlorate, 7% of phenanthrene and 5% of wax, or
- 88% of ammonium perchlorate, 7% of naphthalene and 5% of wax.

According to a second embodiment, the composition may be constituted in mass by 80% of ammonium perchlorate and 20% of anthracene.

According to a third embodiment, the composition may be constituted in mass by: 75 to 91% of perchlorate, 5 to 20% of aromatics and 0.5 to 5% of a nanometric silica powder.

According to different examples it may notably be constituted in mass by:

- 85% of ammonium perchlorate, 10% of anthracene and 5% of nanometric silica powder, or
- 84.5% of ammonium perchlorate, 12.5% of anthracene and 3% of nanometric silica powder.

According to a fourth embodiment, the composition may be constituted in mass by 75 to 91% of perchlorate, 5 to 20% of aromatics, 1 to 6% of binder and 1 to 5% of a nanometric silica powder.

According to different examples it may notably be constituted in mass by:

- 81.5% of ammonium perchlorate, 12.5% of anthracene, 5% of wax and 1% of nanometric silica powder, or
- 82.5% of ammonium perchlorate, 7.5% of anthracene, 5% of wax and 5% of nanometric silica powder, or
- 87% of ammonium perchlorate, 7.5% of anthracene, 2.5% of wax and 3% of nanometric silica powder, or
- 89% of ammonium perchlorate, 7% of anthracene, 2% of wax and 2% of nanometric silica powder.

A first advantage of the pyrotechnic composition according to the invention lies in that it may be used either in the form of a traditional tubular delay column or in that of a delay cord or even be used to make safety fuses.

Another advantage lies in the fact that the combustion rate of the composition may be adjusted whilst guaranteeing stable pyrotechnic behaviour without undesirable gaseous projection.

Another advantage lies in the fact that the composition allows pyrotechnic delays to be made of several seconds to several minutes.

Other characteristics, particulars and advantages of the invention will become more apparent after reading the additional description given hereafter by way of illustration.

DETAILED DESCRIPTION OF PREFERRED EMBODIMENTS

Thus, the composition according to the invention is mainly constituted by an oxidizing salt, such as ammonium perchlorate and an organic reductant component of the aromatics type, such as anthracene, phenanthrene or naphthalene. A binder, for example a wax of the wax-ester or polyethylene wax type, may also be incorporated.

In a known manner the binder or wax coats the composition grains thereby improving the homogeneity of the composition and the mechanical strength of the delay produced. The age-resistance of the delay is also thereby improved, in fact the binder prevents the sedimentation of the different constituents of the composition thereby ensuring its continued homogeneity through time (and thus also its delay performances).

The binder also participates in the pyrotechnic reaction. The quantity of binder that may be used thus enabling the delay's combustion rate to be regulated.

It is also possible to incorporate a nanometric silica powder to the composition according to the invention, whether said composition comprises a binder or not.

A nanometric silica is silica whose mean grain diameter lies between 7 and 40 nanometers. Such silica is sold, for example, under the trade name AEROSIL.

Such silica ensures that the prepared composition is easy to cast, thereby facilitating the loading and implementation operations when a delay column is being produced. It also enables the combustion to be regulated. It does not directly participate in the combustion but the combustion rate may be regulated by acting on the quantity of silica used.

Naturally, the proportions of the constituents must be precisely adjusted so as to obtain a reproducible combustion regime guaranteeing a stable pyrotechnic behaviour without undesirable gaseous projection. In fact, the combustion rate and regime vary depending on the proportion of the components. They also vary according to the nature of the aromatics used.

A binderless composition is implemented by dry process as follows:

To prepare 1 kg of composition, the reductant and the oxidant are introduced into the mixing vessel of a mixer known under the trade name TURBULA. The composition is mixed for about twenty minutes and then removed from the mixer.

The selected fraction of nanometric silica is introduced into the mixing vessel and a fraction of ⅕ of a previously prepared oxidant/reductant mixture is also introduced. This is mixed for 5 minutes. The mixer is sopped and another fraction of ⅕ of the oxidant/reductant mixture is added. This is mixed for 5 minutes. These operations are continued successively until there remains no more of the previously prepared oxidant/reductant mixture.

A composition incorporating a binder (wax, for example) is implemented by wet process as follows:

The wax is dissolved using an appropriate solvent, for example solvent F. Solvent F is the mixture of hydrocarbons resulting in a known manner from the distillation of petrol at between 100° C. and 160° C. (stage F of the distillation columns). The oxidant and the binder solution are then introduced into a planetary mixer or Z-shaped blade mixer of a known type. This is mixed for 5 minutes and then the reductant is added. This is mixed for about a further 15 minutes. The mixture is then removed to a tray and a pre-drying process is carried out under a mechanical extractor. As soon as its consistence makes it possible, the mixture is granulated on a sieve having a mesh size of between 0.5 and 1 mm. The remaining solvent is eliminated afterwards by being dried in a natural ventilation dryer maintained at a temperature of 55° C. ±5° C.

Silica may then be added to a composition incorporating wax by strictly applying the previously described process (dry process).

Contrary to known delay compositions of the $W/BaCrO_4/KClO_4$ type described in the documents quoted in the preamble of the present application, the composition according to the invention has the originality of decomposing mainly in the form of gaseous components.

Thus, in the case of a delay column, this is totally emptied during combustion and its combustion regime is not disturbed.

A vent will advantageously be provided placed at the rear of the delay column or cord (that is to say at the area where the composition is primed). This vent allows the gases to evacuate as they are generated and will prevent the delay cord or column from bursting.

It is known, in fact, for the previously mentioned traditional compositions, which generate little gas, to also produce solid residues that may prevent the gaseous products from evacuating, causing jumps in combustion and sometimes the bursting of the cord or the partial ejection of the delay column. Patent FR 2706 449 proposed introducing a small quantity (0.5 to 1.5% in mass) of nanometric silica into a composition associating tungsten/barium chromate/potassium perchlorate. This additive prevented the sheaths and cords from bursting. It was too small in proportion to substantially modify the combustion rate.

The pyrotechnic composition according to the invention will preferably comprise between 75 and 91% in mass of ammonium perchlorate and between 5 and 20% in mass of an aromatic (for example, anthracene, phenanthrene or naphthalene).

If a binder, for example wax, is incorporated, this will represent 1 to 6% in mass of the composition.

If nanometric silica is incorporated, this will represent 1 to 6% in mass of the composition.

The composition may incorporate both a binder and silica. In this case, according to the process described above, the binder is firstly associated to the oxidant/reductant mixture and the silica is added to the mixture last.

The binder and silica will be dosed so as to obtain the characteristics required for the delay: adjustment of the combustion rate (influenced by the binder and/or silica), mechanical strength and age-resistance (thanks to the binder), improvement of the casting properties (thanks to the silica).

The following examples illustrate different embodiment of the composition according to the invention.

A—EXAMPLE OF A COMPOSITION COMPRISING NEITHER BINDER NOR SILICA.

Example 1

A composition is prepared as described previously that comprises in mass: 80% of ammonium perchlorate and 20% of anthracene.

The composition obtained is loaded by compression into a tubular structure made of aluminum alloy with an inner diameter of 3.8 mm.

A mean combustion rate of 0.86 mm/s is obtained at −32° C. and 0.90 mm/s at +20° C.

When loaded into a delay cord with a tin sheath having an outer diameter of 3.1 mm, a mean combustion rate of 0.80 mm/s is obtained at +20° C. Unfortunately, this composition does not function satisfactorily at −32° C. (suspension of combustion).

B—EXAMPLES OF COMPOSITIONS COMPRISING SILICA BUT NO BINDER

Example 2

A composition is prepared as described previously that comprises in mass 85% of ammonium perchlorate, 10% of anthracene and 5% of nanometric silica (AEROSIL).

This is loaded by compression into a tubular structure made of aluminum alloy with an inner diameter of 3.8 mm.

A mean combustion rate of 0.91 mm/s is obtained at −32° C., 1.00 mm/s at +20° C. and 1.04 mm/s at +44° C.

When loaded into a delay cord with a tin sheath having an outer diameter of 3.1 mm, a mean combustion rate of 0.95 mm/s is obtained at −32° C., 1.05 mm/s at +20° C. and 1.05 mm/s at +44° C.

Example 3

A composition is prepared as described previously that comprises in mass 84.5% of ammonium perchlorate, 12.5% of anthracene and 3% of nanometric silica (AEROSIL).

This is loaded by compression into a tubular structure made of aluminum alloy with an inner diameter of 3.8 mm.

A mean combustion rate of 0.95 mm/s is obtained at −32° C., 1.08 mm/s at +20° C. and 1.12 mm/s at +44° C.

When loaded into a delay cord with a tin sheath having an outer diameter of 3.1 mm, a mean combustion rate of 1.14 mm/s is obtained at −32° C., 1.12 mm/s at +20° C. and 1.10 mm/s at +44° C.

C—EXAMPLES OF COMPOSITIONS COMPRISING BOTH SILICA AND A BINDER

Example 4

A composition is prepared as described previously that comprises in mass 87% of ammonium perchlorate, 7.5% of anthracene and 3% of nanometric silica (AEROSIL) and 2.5% of wax.

This is loaded by compression into a tubular structure made of aluminum alloy with an inner diameter of 3.8 mm.

A mean combustion rate of 0.77 mm/s is obtained at −32° C., 0.96 mm/s at +20° C. and 0.93 mm/s at +44° C.

When loaded into a delay cord with a tin sheath having an outer diameter of 3.1 mm, a mean combustion rate of 0.95 mm/s is obtained at −32° C., 1.02 mm/s at +20° C. and 1.05 mm/s at +44° C.

Example 5

A composition is prepared as described previously that comprises in mass 82.5% of ammonium perchlorate, 7.5% of anthracene and 5% of nanometric silica (AEROSIL) and 5% of wax.

This is loaded by compression into a tubular structure made of aluminum alloy with an inner diameter of 3.8 mm.

A mean combustion rate of 0.87 mm/s is obtained at −32° C., 1.02 mm/s at +20° C. and 1.04 mm/s at +44° C.

When loaded into a delay cord with a tin sheath having an outer diameter of 3.1 mm, a mean combustion rate of 1.18 mm/s is obtained at −32° C., 1.24 mm/s at +20° C. and 1.20 mm/s at +44° C.

Example 6

A composition is prepared as described previously that comprises in mass 81.5% of ammonium perchlorate, 12.5% of anthracene and 1% of nanometric silica (AEROSIL) and 5% of wax.

This is loaded by compression into a tubular structure made of aluminum alloy with an inner diameter of 3.8 mm.

A mean combustion rate of 0.90 mm/s is obtained at −32° C., 0.99 mm/s at +20° C. and at +44° C.

When loaded into a delay cord with a tin sheath having an outer diameter of 3.1 mm, a mean combustion rate of 1.17 mm/s is obtained at −32° C., 1.09 mm/s at +20° C. and 1.05 mm/s at +44° C.

Example 7

A composition is prepared as described previously that comprises in mass 89% of ammonium perchlorate, 7% of anthracene and 2% of nanometric silica (AEROSIL) and 2% of wax.

This is loaded by compression into a tubular structure made of aluminum alloy with an inner diameter of 3.8 mm.

A mean combustion rate of 0.95 mm/s is obtained at −32° C., 0.86 mm/s at +20° C.

When loaded into a delay cord with a tin sheath having an outer diameter of 3.1 mm, a mean combustion rate of 0.92 mm/s is obtained at −32° C., 1.00 mm/s at +20° C.

D—EXAMPLES OF COMPOSITIONS COMPRISING A BINDER WITH NO SILICA

Example 8

A composition is prepared as described previously that comprises in mass 91% of ammonium perchlorate, 7% of anthracene and 2% of wax.

This is loaded into a delay cord with a tin sheath having an outer diameter of 3.1 mm.

A mean combustion rate of 0.93 mm/s is obtained at −32° C. and 0.92 mm/s at +20° C.

Example 9

A composition is prepared as described previously that comprises in mass 88% of ammonium perchlorate, 7% of anthracene and 5% of wax.

When loaded into a delay cord with a tin sheath having an outer diameter of 3.1 mm, a mean combustion rate of 0.94 mm/s is obtained at −32° C., 0.95 mm/s at +20° C. and 0.97 mm/s at +44° C.

Example 10

A composition is prepared as described previously that comprises in mass 88% of ammonium perchlorate, 7% of phenanthrene and 5% of wax.

When loaded into a delay cord with a tin sheath having an outer diameter of 3.1 mm, a mean combustion rate of 0.89 mm/s is obtained at −32° C. and 0.90 mm/s at +20° C.

Example 11

A composition is prepared as described previously that comprises in mass 88% of ammonium perchlorate, 7% of naphthalene and 5% of wax.

When loaded into a delay cord with a tin sheath having an outer diameter of 3.1 mm, a mean combustion rate of 0.87 mm/s is obtained at −32° C. and 0.94 mm/s at +20° C.

The compositions according to the invention all have combustion rates in the vicinity of 1 mm/s. We can see that the above examples provide the expert with a wide range of compositions adapted to an implementation in the form of a delay cord, rigid column or fuse.

What is claimed is:

1. A slow combustion pyrotechnic composition notably intended to manufacture pyrotechnic delays, said composition wherein it comprises an oxidant of the perchlorate type according to a percentage in mass of between 75 and 91%, a reductant according to a percentage in mass of between 5 and 20%, 0 to 6% in mass of a binder and 0 to 5% in mass of a silica powder having mean grain diameter in the range of 7 to 40 nanometers, wherein the oxidant is ammonium perchlorate and wherein the reductant is selected from the group consisting of anthracene, phenanthrene, naphthalene and mixtures thereof.

2. A slow combustion pyrotechnic composition according to claim 1, wherein it comprises a binder that is constituted by a wax.

3. A slow combustion pyrotechnic composition according to claim 1, wherein it is constituted in mass by 75 to 91% of ammonium perchlorate, 5 to 20% of reductant and 1 to 6% of binder.

4. A slow combustion pyrotechnic composition according to claim 2, wherein it is constituted in mass by 91% of ammonium perchlorate, 7% of anthracene and 2% of wax.

5. A slow combustion pyrotechnic composition according to claim 2, wherein it is constituted in mass by 88% of ammonium perchlorate, 7% of anthracene and 5% of wax.

6. A slow combustion pyrotechnic composition according to claim 2, wherein it is constituted in mass by 88% of ammonium perchlorate, 7% of phenanthrene and 5% of wax.

7. A slow combustion pyrotechnic composition according to claim 2, wherein it is constituted in mass by 88% of ammonium perchlorate, 7% of naphthalene and 5% of wax.

8. A slow combustion pyrotechnic composition according to claim 1, wherein it is constituted in mass by 80% of ammonium perchlorate and 20% of anthracene.

9. A slow combustion pyrotechnic composition according to claim 1, wherein it is constituted in mass the by: 75 to 91% of ammonium perchlorate, 5 to 20% of reductant and 0.5 to 5% of a silica powder having mean grain diameter in the range of 7 to 40 nanometers.

10. A slow combustion pyrotechnic composition according to claim 9, wherein it is constituted in mass by 85% of ammonium perchlorate, 10% of anthracene and 5% of a silica powder having mean grain diameter in the range of 7 to 40 nanometers.

11. A slow combustion pyrotechnic composition according to claim 9, wherein it is constituted in mass by 84.5% of ammonium perchlorate, 12.5% of anthracene and 3% of a silica powder having mean grain diameter in the range of 7 to 40 nanometers.

12. A slow combustion pyrotechnic composition according to claim 1, wherein it is constituted in mass by 75 to 91% of ammonium perchlorate, 5 to 20% of reductant, 1 to 6% of binder and 1 to 5% of a silica powder having mean grain diameter in the range of 7 to 40 nanometers.

13. A slow combustion pyrotechnic composition according to claim 12, wherein it is constituted in mass by 81.5% of ammonium perchlorate, 12.5% of anthracene, 5% of wax and 1% of a silica powder having mean grain diameter in the range of 7 to 40 nanometers.

14. A slow combustion pyrotechnic composition according to claim 12, wherein it is constituted in mass by 82.5% of ammonium perchlorate, 7.5% of anthracene, 5% of wax and 5% of a silica powder having mean grain diameter in the range of 7 to 40 nanometers.

15. A slow combustion pyrotechnic composition according to claim 12, wherein it is constituted in mass by 87% of ammonium perchlorate, 7.5% of anthracene, 2.5% of wax and 3% of a silica powder having mean grain diameter in the range of 7 to 40 nanometers.

16. A slow combustion pyrotechnic composition according to claim 12, wherein it is constituted in mass by 89% of ammonium perchlorate, 7% of anthracene, 2% of wax and 2% of a silica powder having mean grain diameter in the range of 7 to 40 nanometers.

* * * * *